US008161927B2

(12) United States Patent
Ochiai et al.

(10) Patent No.: US 8,161,927 B2
(45) Date of Patent: Apr. 24, 2012

(54) VALVE SYSTEM FOR OVERHEAD-CAMSHAFT-TYPE INTERNAL COMBUSTION ENGINE, AND ENGINE INCORPORATING SAME

(75) Inventors: Shuichi Ochiai, Saitama (JP); Hiroshi Kuribara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 752 days.

(21) Appl. No.: 12/284,761

(22) Filed: Sep. 25, 2008

(65) Prior Publication Data

US 2009/0101096 A1 Apr. 23, 2009

(30) Foreign Application Priority Data

Oct. 19, 2007 (JP) ..... 2007-272511

(51) Int. Cl.
*F01L 1/02* (2006.01)

(52) U.S. Cl. ..... 123/90.27; 123/90.39; 123/195 R

(58) Field of Classification Search ..... 123/195 R, 123/193.5, 90.39, 90.38, 90.6, 90.37; 74/567
See application file for complete search history.

(56) References Cited

U.S. PATENT DOCUMENTS 4,823,747 A * 4/1989 Wagner et al. ..... 123/193.5
2005/0120992 A1* 6/2005 Rieger et al. ..... 123/193.5

FOREIGN PATENT DOCUMENTS

JP 2002-122007 4/2002

* cited by examiner

*Primary Examiner* — Zelalem Eshete
(74) *Attorney, Agent, or Firm* — Carrier Blackman & Associates, P.C.; Joseph P. Carrier; William D. Blackman

(57) ABSTRACT

A valve system of an overhead-camshaft-type internal combustion engine includes a cam holder fastened to a cylinder head having a combustion chamber formed therein. The cam holder supports a camshaft, and is disposed above the combustion chamber. The cam holder includes a bottom wall, a pair of oppositely-facing support walls having lower sides thereof joined with each other by the bottom wall, and a rib joining predetermined oppositely-facing portions of respective upper side portions of the support walls with each other. The support walls of the cam holder pivotally support the cam shaft. The rib may be integrated with the cam holder, or may be separately formed and fastened to the support walls of the cam holder.

13 Claims, 9 Drawing Sheets

VALVE SYSTEM FOR OVERHEAD-CAMSHAFT-TYPE INTERNAL COMBUSTION ENGINE, AND ENGINE INCORPORATING SAME

CROSS-REFERENCE TO RELATED APPLICATIONS

The present application claims priority under 35 USC §119 based on Japanese patent application No. 2007-272511, filed on Oct. 19, 2007. The entire subject matter of this priority document is incorporated by reference herein.

BACKGROUND OF THE INVENTION

1. Field of the Invention

The present invention relates to a valve system of an overhead-camshaft-type internal combustion engine, and an engine incorporating same. More particularly, the present invention relates to a reinforced cam holder which pivotally supports a camshaft of the valve system.

2. Description of the Background Art

There is a known valve system of an overhead cam-shaft-type internal combustion engine in which a cam holder, which pivotally supports a camshaft by both oppositely-facing support walls having lower sides thereof joined to each other by a bottom wall, is fastened to a cylinder head above a combustion chamber. An example of such valve system of an overhead cam-shaft-type internal combustion engine is disclosed in the Japanese Patent Document JP-A-2002-122007.

The overhead-camshaft-type internal combustion engine disclosed the Japanese Patent Document JP-A-2002-122007 is a single-cylinder 4-cycle internal combustion engine. The internal combustion engine is mounted on a motorcycle such that a crankshaft of the internal combustion engine is directed in the vehicle width direction (lateral direction). A cam holder, fastened to a cylinder head above the combustion chamber, has a structure in which left and right oppositely-facing support walls having lower sides thereof joined to each other by a bottom wall pivotally supports the camshaft which is directed in the lateral direction, and fastening boss portions formed on front and rear side portions of the left and right support walls are fastened to the cylinder head using bolts.

The left and right support walls of the cam holder pivotally support not only the camshaft but also a rocker arm shaft by rocker bearing portions arranged in front of the left and right support walls. The rocker arms which are pivotally supported on the rocker arm shaft transmit the rotation of exhaust cam robes of the camshaft for open/close driving of exhaust valves, and an intake valve is directly opened or closed by an intake cam robe of the camshaft.

The cam holder which is fastened to the cylinder head is arranged above a portion of the cylinder head which constitutes a combustion chamber. Since the portion which constitutes the combustion chamber repeats the expansion and the contraction due to a change of pressure in the combustion chamber, the cam holder whose front and rear side portions of the left and right support walls are fastened to the cylinder head using bolts repeatedly receives a force which widens or narrows a distance between the left and right support walls. Hence, the cam holder is likely to be deformed due to such repetition of widening or narrowing of the distance between the support walls.

Accordingly, to overcome such drawback attributed to the repetitious deformation, a wall thickness of the portion of the cam holder to which a stress is applied is increased to ensure the rigidity of the cam holder. In this case, however, it is difficult to realize the reduction of weight of the cam holder.

Here, in the cam holder, a side wall is formed between rear side portions of the left and right support walls. Hence, the rigidity of the cam holder between the rear side portions of the left and right support walls is high so that the deformation of the cam holder is hardly generated between the rear side portions. However, the deformation of the cam holder attributed to the repetitious widening or narrowing of the distance between the support walls is easily generated between front side portions of the cam holder.

Further, the rocker arms are supported between the front side portions of the left and right support walls and hence, a force which acts on the rocker arm is applied to further widen or narrow the distance between the front side portions of the left and right support walls. Accordingly, the deformation attributed to widening or narrowing of the distance between the support walls is further easily generated in left and right front side portions.

In order to prevent (or minimize) the generation of the deformation attributed to widening or narrowing the distance between the support walls, it is necessary to ensure the rigidity by increasing a thickness of the portion of the cam holder which is influenced by a stress and hence, it is more difficult to realize the reduction of weight of the cam holder.

The present invention has been made to overcome such drawbacks. Accordingly, it is one of the objects of the present invention to provide a valve system for an overhead-camshaft-type internal combustion engine which can prevent the deformation of a cam holder for enhancing the durability of the cam holder and realizing the reduction of weight of the cam holder.

SUMMARY OF THE INVENTION

In order to achieve the above objects, the present invention according to a first aspect thereof provides a valve system for an overhead-camshaft-type internal combustion engine in which a cam holder is fastened to a cylinder head having a combustion chamber formed therein. The cam holder includes a bottom wall, and a pair of oppositely-facing support walls having lower sides thereof joined to each other by said bottom wall. A rib joins predetermined oppositely-facing portions of respective upper side portions of the support walls with each other.

The present invention according to a second aspect thereof is characterized in that the cam holder includes a plurality of rocker bearing portions which pivotally respective one of support rocker arms in a rockable manner in the vicinity of respective side portions of both support walls, and portions of the respective upper side portions of both support walls above the rocker bearing portions are joined to each other by the rib.

The present invention according to a third aspect thereof is characterized in that the rib is integrally formed with the cam holder.

The present invention according to a fourth aspect thereof is characterized in that the rib is formed as a body separate from the cam holder and extends between predetermined portions of on the respective upper side portions of both support walls of the cam holder, and the rib is fastened together with the cam holder using a fastening member which fastens the cam holder to the cylinder head.

The present invention according to a fifth aspect thereof is characterized in that a side wall which extends upwardly from the bottom wall of the cam holder is configured to join both oppositely-facing side portions of both support walls on a side opposite to side portions of both the support walls on which the rocker bearing portions are formed.

ADVANTAGES OF THE INVENTION

According to the valve system of the overhead-camshaft-type internal combustion engine described in the first aspect, the oppositely-facing predetermined portions of the respective upper side portions of both support walls, which support the camshaft of the cam holder which is fastened to the cylinder head above the combustion chamber, are joined to each other by the rib thus providing the structure in which the oppositely-facing support walls have the lower sides thereof joined to each other by the bottom wall and the predetermined parts of the upper side portions are joined to each other by the rib.

Accordingly, the cam holder can acquire the extremely high structural rigidity without increasing a wall thickness of the cam holder. Hence, even when a portion constituting the combustion chamber of the cylinder head to which the cam holder is fastened expands or contracts due to a change of pressure in the combustion chamber, the deformation of both support walls of the cam holder attributed to the widening or narrowing of a distance between both support walls can be prevented (or at least minimized), thus realizing the enhancement of the durability and the reduction of weight of the cam holder.

According to the valve system of the overhead-camshaft-type internal combustion engine as described in the second aspect, portions of respective upper side portions of both support walls above the rocker bearing portions are joined to each other by the rib. Hence, even when a force which acts on the rocker arm operates to widen or narrow the distance between the left and right support walls, the deformation of the cam holder between the left and right support walls attributed to widening or narrowing of the distance between the support walls is hardly generated. Accordingly, it is unnecessary to ensure the rigidity of the cam holder by increasing wall thicknesses of the portions which are influenced by a stress and hence, it is possible to realize the further reduction of weight of the cam holder.

According to the valve system of the overhead-camshaft-type internal combustion engine as described in the third aspect, the rib is integrally formed with the cam holder. Hence, it is possible to reduce the number of parts thus facilitating the assembling operation.

According to the valve system of the overhead-camshaft-type internal combustion engine as described in fourth aspect, the rib is formed as the body separate from the cam holder and extends between the predetermined portions of the respective upper side portions of both support walls of the cam holder, and the rib is fastened together with the cam holder using the fastening member which fastens the cam holder to the cylinder head. Hence, it is possible to adjust strength of the cam holder with the simple modifications of the rib.

According to the valve system of the overhead-camshaft-type internal combustion engine as described in the fifth aspect, the side wall which extends upwardly from the bottom wall of the cam holder is configured to join both oppositely-facing side portions of both support walls on a side opposite to the side portions of both support walls on which the rocker bearing portions are formed.

Hence, the upper portions of side portions of both support walls on which the rocker bearing portions are formed are joined to each other using the rib and the side portions of the support walls on the side opposite to the side portions of the support walls on which the rocker bearing portions are formed are joined by the side wall. Accordingly, the cam holder can ensure the high structural rigidity and, at the same time, it is possible to easily lubricate a valve drive system by reserving oil using the bottom wall and the side wall.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

Hereinafter, one embodiment according to the invention is explained in conjunction with FIG. 1 to FIG. 8.

An internal combustion engine E of this embodiment is a water-cooled overhead-camshaft-type 4-cycle internal combustion engine which is mounted on a motorcycle in a state that a crankshaft of the engine is directed in a vehicle width direction. In the internal combustion engine E, a cylinder 1 and a cylinder head 2 extend in the substantially upward direction from a crankcase in a state that the cylinder 1 and the cylinder head 2 overlap with each other, and a cylinder head cover 3 is mounted on the cylinder head 2. The cylinder head cover covers a valve system 20 mounted on the cylinder head 2.

Figure 1:
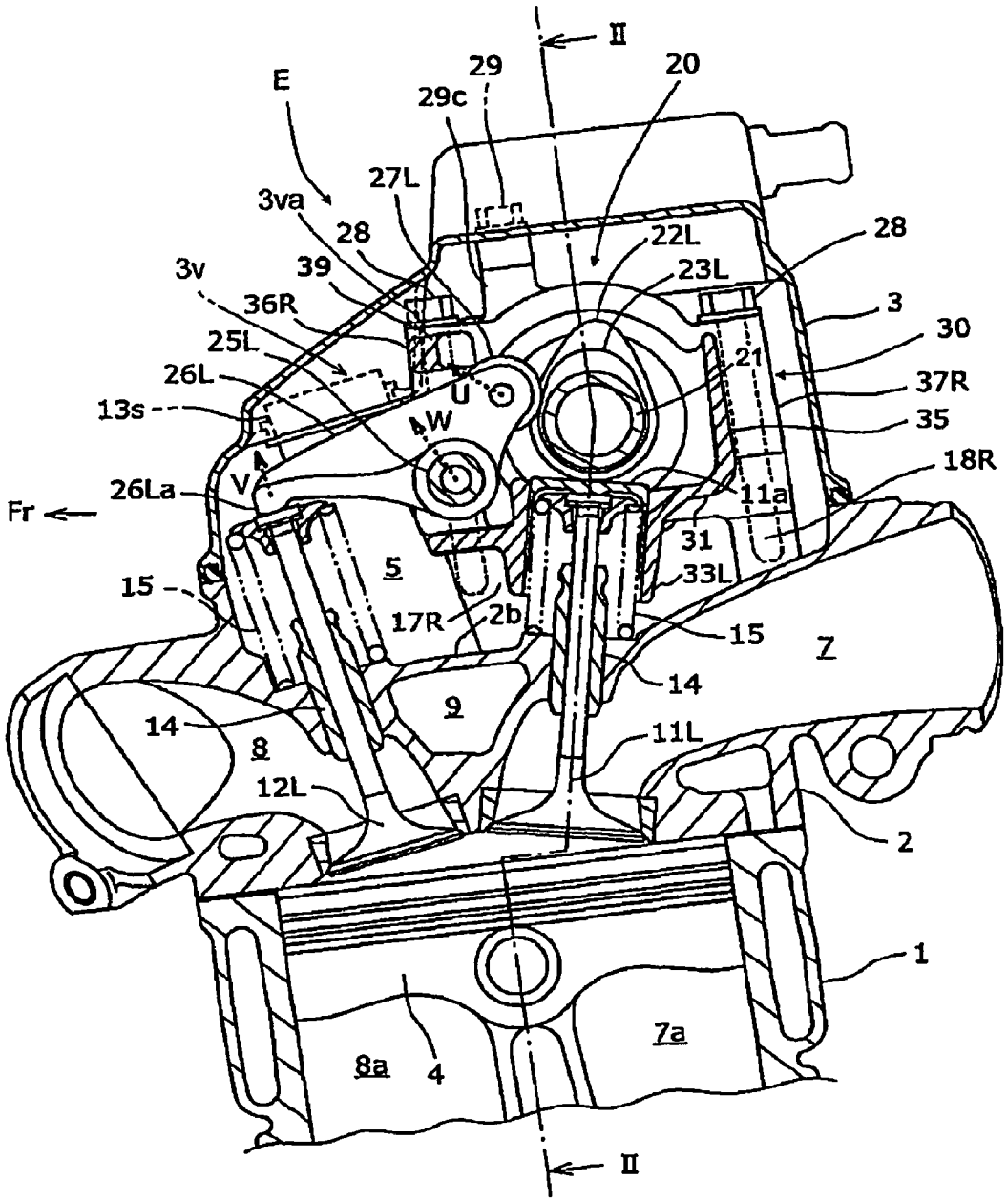
FIG. 1 is a cross-sectional view showing an upper portion of a cylinder of an internal combustion engine according to an embodiment of the present invention as viewed from a left side.
Figure 2:
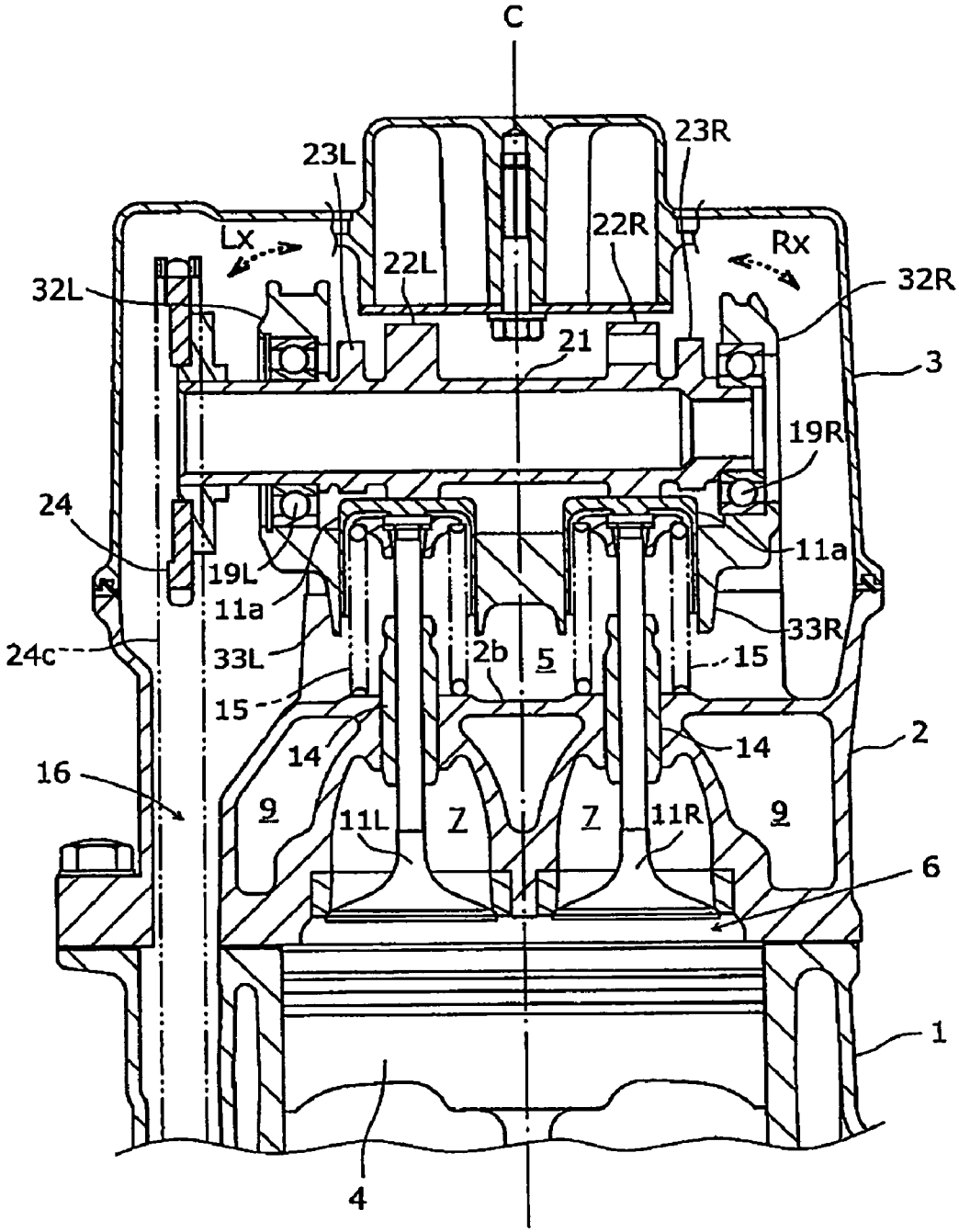
FIG. 2 is a cross-sectional view of the upper portion of the cylinder as viewed from a rear side (cross-sectional view taken along a line II-II in FIG. 1).

FIG. 1 is a cross-sectional view of an upper portion of the cylinder 1 of the internal combustion engine E as viewed from a left side, and FIG. 2 is a cross-sectional view of the upper portion of the cylinder 1, as viewed from a rear side.

Figure 3:
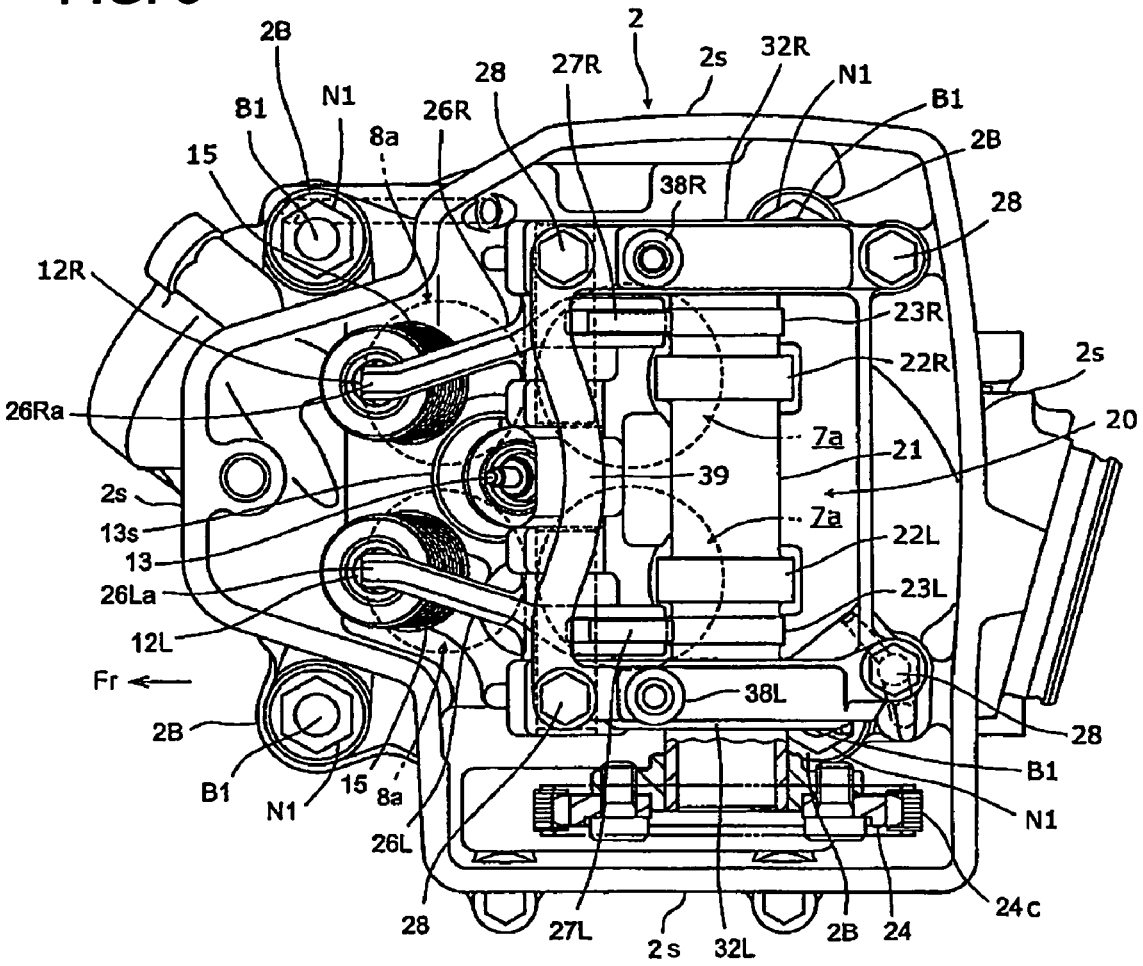
FIG. 3 is a top plan view showing a cylinder head (from which a cylinder head cover is removed) and a valve system arranged on an upper portion of the cylinder head.
Figure 4:
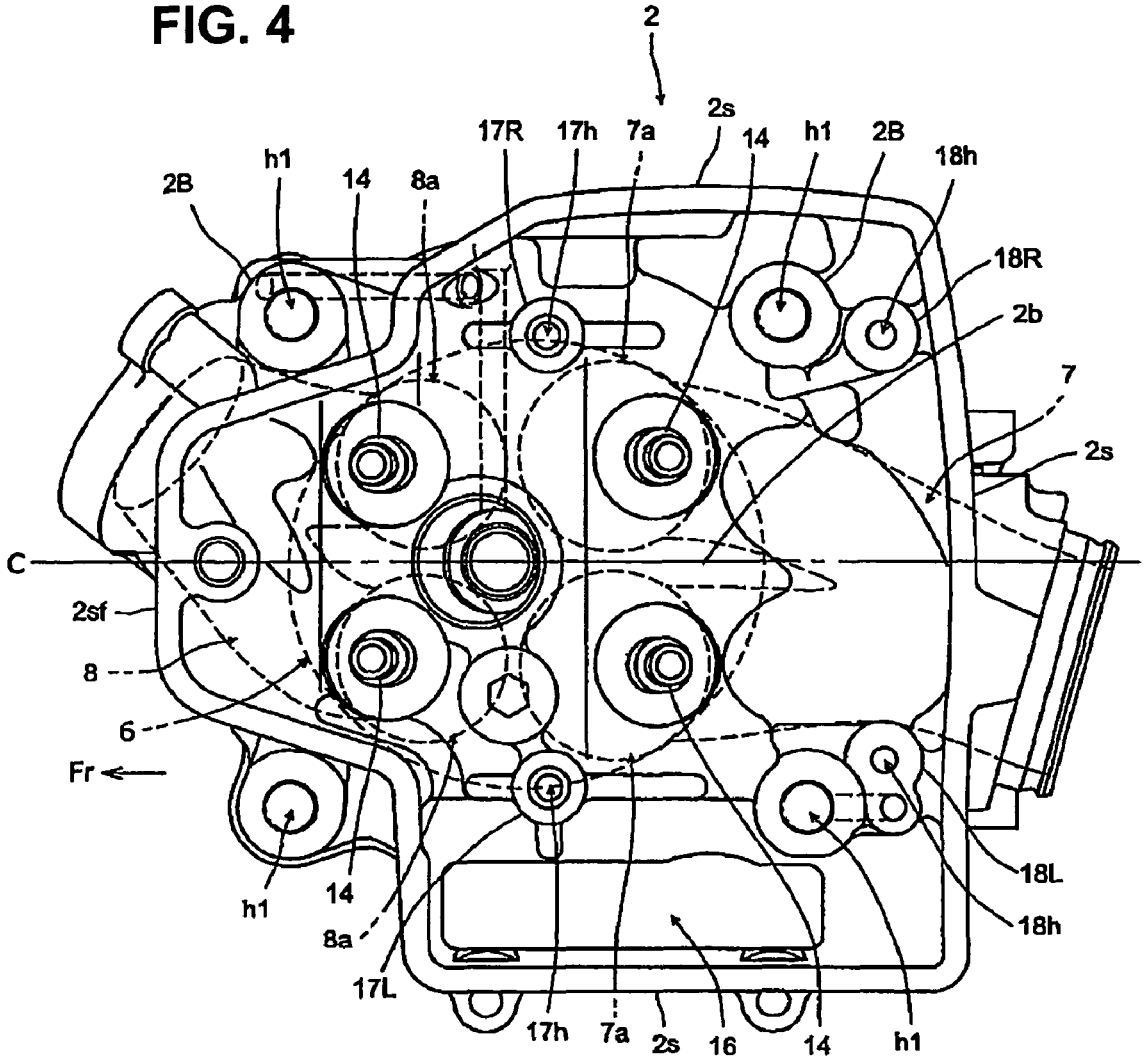
FIG. 4 is a top plan view of the cylinder head.
Figure 5:
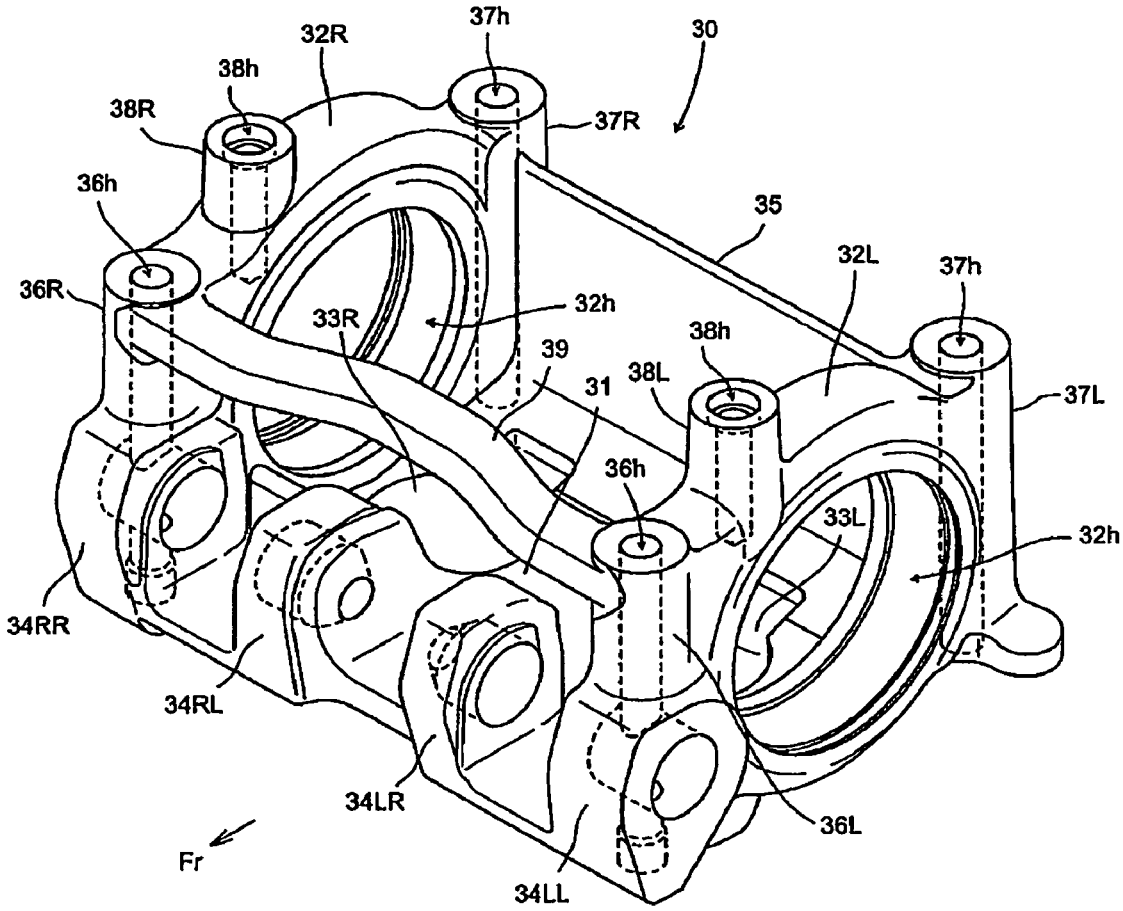
FIG. 5 is a perspective view of a cam holder.
Figure 6:
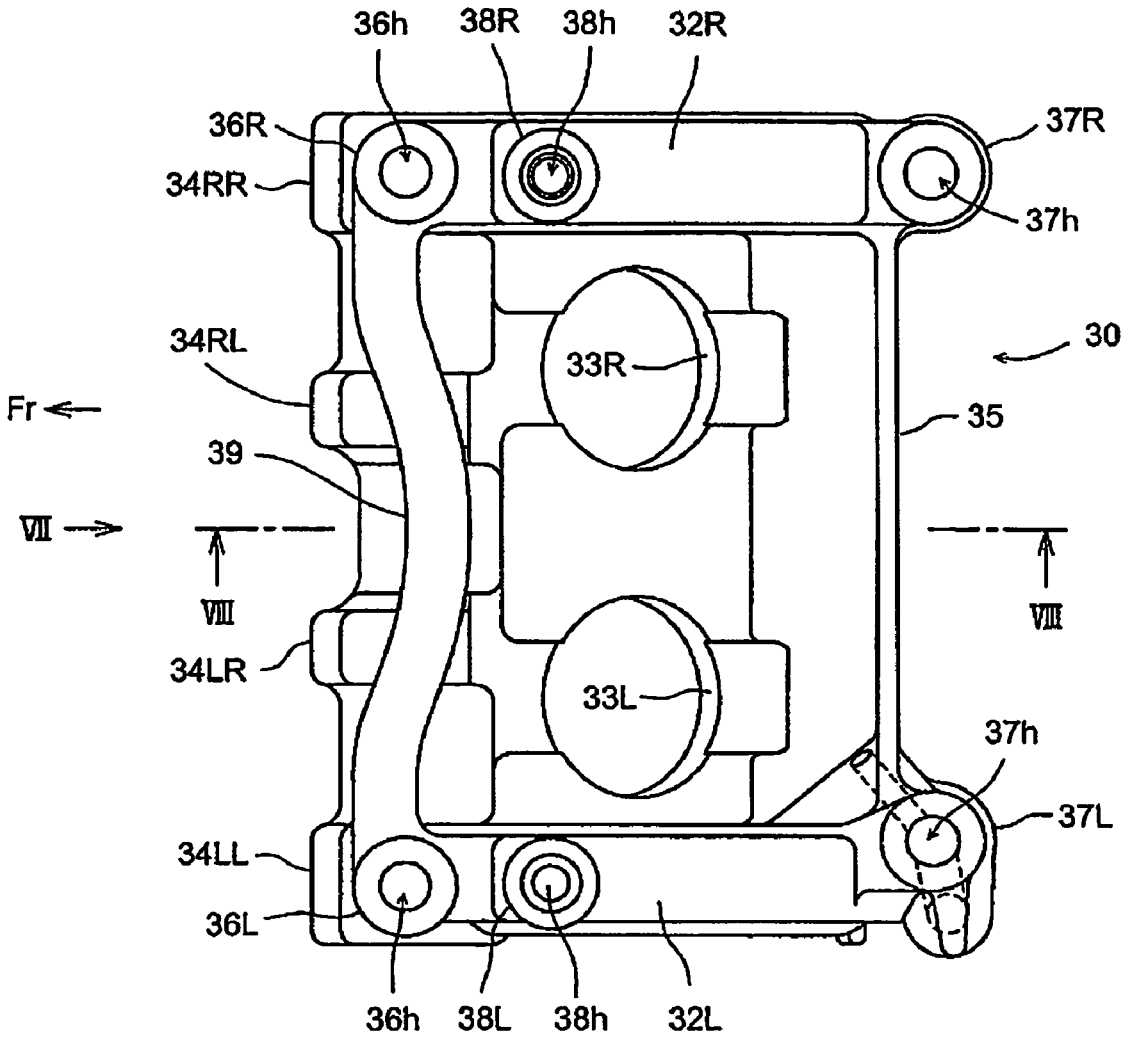
FIG. 6 is a top plan view of the cam holder.

Further, FIG. 3 is a top plan view showing the cylinder head 2 from which the cylinder head cover 3 is removed and the valve system 20 mounted on an upper portion of the cylinder head 2, and FIG. 4 is a top plan view of the cylinder head 2 from which the valve system 20 is removed.

In illustrative embodiments of the present invention, the front and rear directions and the left and right directions are determined based on a vehicle, wherein the advancing direction of the vehicle is a frontward direction, the retracting direction of the vehicle is a rearward direction, and the vehicle widthwise direction is a lateral direction.

In the cylinder head 2, a combustion chamber 6 is formed such that the combustion chamber 6 faces a piston 4 reciprocating in the cylinder 1 in an opposed manner in the cylinder axis direction. Further, in the cylinder head 2, an intake port 7 having a pair of left and right intake openings 7*a* which opens at a rear side of the combustion chamber 6 is formed in a rearwardly extending manner, while an exhaust port 8 having a pair of left and right exhaust openings 8*a* which opens at a front side of the combustion chamber 6 is formed in a frontwardly extending manner.

Further, a pair of left and right rear intake valves 11L, 11R and a pair of left and right front exhaust valves 12L, 12R which are operable to open and close both intake openings 7*a* and both exhaust openings 8*a* respectively (all valves being formed of a poppet valve), and an ignition plug 13 (see FIG. 3) which faces a center portion of the combustion chamber 6 are disposed the cylinder head 2.

The ignition plug 13 is mounted on the cylinder head 2 by inserted in a cylindrical housing sleeve 13*s*.

The intake valves 11L, 11R and the exhaust valves 12L, 12R which constitute engine valves are slidably fitted and inserted in respective valve guides 14 which are press-fitted in the cylinder head 2, and are always biased in the valve-closing direction due to a biasing force of valve springs 15.

The intake valves 11L, 11R and the exhaust valves 12L, 12R are driven by the valve system 20, to open or close the intake openings 7*a* of the intake port 7 and the exhaust openings 8*a* of the exhaust port 8 which open in the combustion chamber 6 in synchronism with the engine rotation.

In the cylinder head 2, a substantially rectangle-shaped valve chamber 5 defined by a peripheral wall 2*s* and a bottom wall 2*b* is formed above the combustion chamber 6, and the valve system 20 is arranged in the inside of the valve chamber 5.

Between the bottom wall 2*b* of the valve chamber 5 and the combustion chamber 6, the intake port 7, and the exhaust port 8 and a water jacket 9 are formed.

In order to explain the constitution of an illustrative embodiment of the present invention in conjunction with FIG. 4, a front side wall of the peripheral wall 2*s* forms a front projecting wall 2*sf* which projects frontwardly together with the exhaust port 8 at a position where the exhaust port 8 is arranged, and a rectangle-shaped cam chain chamber 16 is formed in a left sidewall of the peripheral wall 2*s* along a left side wall in a vertically penetrating manner.

Fastening boss portions 2B, 2B which respectively form stud bolt holes h1, h1 therein are formed laterally outside of the front projecting wall 2*sf* of the peripheral wall 2*s* in a projecting manner, and fastening boss portions 2B, 2B which respectively form stud bolt holes h1, h1 therein are formed inside the peripheral wall 2*s* in the vicinity of left and right sides of the rear side wall of the peripheral wall 2*s*.

In the stud bolt holes h1 formed in the four fastening boss portions 2B, respective stud bolts B1 penetrate, and these stud bolts B1 integrally fasten the cylinder head 2 to the crankcase via the cylinder 1 together with fastening nuts N1 (see FIG. 3).

Mounting boss portions 17L, 17R in which threaded holes 17*h*, 17*h* are respectively formed are formed at positions laterally outside and in the vicinity of the left and right intake openings 7*a*, 7*a* formed in the bottom wall 2*b* of the valve chamber 5 in the oblique frontward direction. Further, mounting boss portions 18L, 18R in which threaded holes 18*h*, 18*h* are respectively formed are formed along the rear side wall of the peripheral wall 2*s* of the bottom wall 2*b* and behind the rear fastening boss portions 2B, 2B.

Mounting seat surfaces formed on upper ends of the above-mentioned four mounting boss portions 17L, 17R, 18L and 18R are coplanar with a mating surface of the peripheral wall 2*s* with the cylinder head cover 3.

On the four mounting boss portions 17L, 17R, 18L and 18R, a cam holder 30 which pivotally supports a camshaft 21 of the valve system 20 is mounted.

The structure of the cam holder 30 is explained in conjunction with FIG. 5 to FIG. 8.

In the left and right support walls 32L, 32R having lower sides thereof joined to each other by a bottom wall 31 and facing each other in an opposed manner, large-diameter bearing circular holes 32*h*, 32*h* which pivotally support one camshaft 21 by way of bearings 19L, 19R are coaxially formed.

On left and right portions of the bottom wall 31, cylindrical lifter guides 33L, 33R are formed in an obliquely and downwardly extending manner. The lifter guides 33L, 33R slidably guide valve lifters 11*a*, 11*a* which cover upper ends of the left and right intake valves 11, 11.

On left and right portions of a front side of the bottom wall 31, a pair of left rocker bearing boss portions 34LL, 34LR, and a pair of right rocker bearing boss portions 34RL, 34RR are respectively formed in a raised manner.

The left rocker bearing boss portions 34LL, 34LR and the right rocker bearing boss portions 34RL, 34RR are arranged in this order in a state that respective bearing holes formed in these bearing boss portions are arranged coaxially. Here, the left rocker bearing boss portion 34LL at a left end is integrally formed with a front side portion of the left support wall 32L, and the right rocker bearing boss portion 34RR at a right end is integrally formed with a front side portion of the right support wall 32R.

A left rocker arm shaft 25L extends between the left rocker bearing boss portions 34LL, 34LR in a state that both ends of the rocker arm shaft 25R are respectively supported on the left rocker bearing boss portions 34LL, 34LR, and a right rocker arm shaft 25R extends between the right rocker bearing boss portions 34RL, 34RR in a state that both ends of the right rocker arm shaft 25R are supported on the right rocker bearing boss portions 34RL, 34RR.

A rear side wall 35 which contiguously extends upwardly from a rear side of the bottom wall 31 is provided for joining both rear side portions of the left and right support walls 32L, 32R.

Mounting boss portions 36L, 36R in which the bolt holes 36*h*, 36*h* are formed in the vertical direction are formed on the front side portions of the respective left and right support walls 32L, 32R. The bolt holes 36*h*, 36*h* intersect the bearing holes formed in the left rocker bearing boss portion 34LL and the right rocker bearing boss portion 34RR.

Further, on the respective rear side portions of the left and right support walls 32L, 32R, mounting boss portions 37L, 37R in which the bolt holes 37*h*, 37*h* are formed in the vertical direction are formed.

Further, on portions of the respective upper side portions of the left and right support walls 32L, 32R at positions arranged closer to the center of the support walls 32L, 32R from a front side, mounting boss portions 38L, 38R in which screw holes 38*h*, 38*h* are formed vertically are formed in an upwardly projecting manner.

Further, the cam holder 30 of this embodiment is formed of an integral body by joining front end portions of the upper side portions of the respective left and right support walls 32L, 32R (upper end portions of the mounting boss portions 36L, 36R) by the rib 39 which extends between the support walls 32L, 32R in the laterally horizontal direction.

In the cylinder head 2, a housing sleeve 13*s* in which the ignition plug 13 is housed is formed with a short length for reducing a weight of the cylinder head 2. For this end, a portion of the cylinder head cover 3 where the housing sleeve 13*s* is positioned is recessed in the downward direction to form a recessed portion 3*v* (see FIG. 1), and a center portion of the rib 39 is slightly bent in the rearward direction for avoiding a vertical wall 3*va* of the recessed portion 3*v*.

As discussed herein, the cam holder 30 of this embodiment adopts the structure that the left and right support walls 32L, 32R which pivotally support the camshaft 21 have the lower sides thereof joined to each other by the bottom wall 31, have the rear sides of the left and right support walls 32L, 32R are joined to each other by the rear side wall 35 and, further, the front ends of the upper side portions of the support walls 32L, 32R are joined to each other by the rib 39.

Accordingly, the cam holder 30 can possess the extremely high structural rigidity and can realize the reduction of weight without increasing a wall thickness of a portion thereof to which a stress is applied.

Bearings 19L, 19R are inserted to the bearing circular holes 32*h*, 32*h* formed in the left and right support walls 32L, 32R of the cam holder 30 having such structure, and the camshaft 21 is rotatably and pivotally supported by the bearings 19L, 19R (see FIG. 2).

As shown in FIG. 3, on the camshaft 21, which is pivotally supported on the cam holder 30 in the laterally extending manner, exhaust cam robes 23L, 23R which constitute exhaust valve operating cams are respectively formed close to respective inner sides of the left and right bearings 19L, 19R. On the other hand, intake cam robes 22L, 22R which constitute intake valve operating cams are respectively formed close to respective inner sides of the left and right exhaust cam robes 23L, 23R. Further, the lifter guides 33L, 33R are respectively arranged below the intake cam robes 22L, 22R.

On a left end portion of the camshaft 21 which projects leftwardly from the left bearing 19L, a driven chain sprocket wheel 24 is mounted by fitting engagement.

Further, the rocker arm shaft 25L which pivotally and rotatably supports the left exhaust rocker arm 26L extends between the left rocker bearing boss portions 34LL, 34LR of the cam holder 30 in a state that both ends of the rocker arm shaft 25L are supported on the left rocker bearing boss portions 34LL, 34LR, while the rocker arm shaft 25R which slidably and pivotally supports the right exhaust rocker arm 26R extends between the right rocker bearing boss portions 34RL, 34RR in a state that both ends of the rocker arm shaft 25R are supported on the right rocker bearing boss portions 34RL, 34RR.

The left and right exhaust rocker arms 26L, 26R are arranged below the rib 39, rollers 27L, 27R are rotatably and pivotally supported on respective rearwardly-extending end portions of the left and right exhaust rocker arms 26L, 26R, and the rollers 27L, 27R are brought into contact with the exhaust cam robes 23L, 23R formed on the camshaft 21.

Respective frontwardly-extending end portions 26La, 26Ra of the exhaust rocker arms 26L, 26R are brought into contact with the upper ends of the exhaust valves 12L, 12R respectively (see FIG. 1).

As described above, the cam holder 30 to which the camshaft 21, the rocker arm shafts 25L, 25R and the exhaust rocker arms 26L, 26R are assembled is fixed to the bottom wall 2*b* of the valve chamber 5 of the cylinder head 2.

In mounting the cam holder 30 on the cylinder head 2, the valve lifters 11*a*, 11*a* which covers the upper ends of the intake valves 11L, 11R projecting from the bottom wall 2*b* of the valve chamber 5 of the cylinder head 2 are inserted into the lifter guides 33L, 33R formed in the bottom wall 31 of the cam holder 30.

Further, lower end surfaces of the mounting boss portions 36L, 36R, 37L, 37R of the cam holder 30 are aligned with mounting seat surfaces formed on upper ends of the above-mentioned four mounting boss portions 17L, 17R, 18L, 18R of the cylinder head 2, and four flange bolts 28 are made to penetrate bolt holes 36*h*, 36*h*, 37*h*, 37*h* formed in the cam holder 30 respectively from above, and are threaded into screw holes 17*h*, 17*h*, 18*h*, 18*h* formed in the cylinder head 2 thus fastening the cam holder 30 to the cylinder head 2.

The camshaft 21, which is pivotally supported on the left and right support walls 32L, 32R of the cam holder 30, is brought into direct contact with upper surfaces of the valve lifters 11*a*, 11*a* having the intake cam robes 22L, 22R which cover upper ends of the intake valves 11L, 11R respectively.

The left and right exhaust rocker arms 26L, 26R which are pivotally supported on the rocker bearing boss portions 34LL, 34LR, 34RL, 34RR are arranged at left and right positions with the housing sleeve 13*s* which houses the ignition plugs 13 therein sandwiched therebetween, and end portions 26La, 26Ra which extend frontwardly are respectively brought into contact with the upper end of the exhaust valves 12L, 12R.

Further, the cam chain 24*c* is wound between and around the driven chain sprocket wheel 24 fitted on the left end portions of the camshaft 21 and the crankshaft thus constituting the valve system 20.

When the valve system 20 mounted on the valve operating chamber 5 of the cylinder head 2 is covered with the cylinder head cover 3, the left and right bolts 29, 29 penetrate the ceiling wall of the cylinder head 2 which is in contact with the upper end surfaces of the collars 29*c*, 29*c* overlapped to upper end surfaces of the mounting boss portions 38L, 38R formed on the left and right support walls 32L, 32R of the cam holder 30 in a projecting manner, and the bolts 29, 29 are threaded into screw holes 38*h*, 38*h* formed in the mounting boss portions 38L, 38R by way of the collars 29*c*, 29*c* thus fixing the cylinder head cover 3 to the cylinder head 2.

The valve system 20 of this embodiment is arranged above the cylinder head 2 of the overhead-camshaft-type internal combustion engine E as described above.

When the rotation of the crankshaft is transmitted to the camshaft 21 by way of the cam chain 19 due to the operation of the internal combustion engine E, the rotation of the intake cam robes 22L, 22R provides the direct open/close driving of the intake valves 11L, 11R at predetermined timing, while the rotation of the exhaust cam robes 23L, 23R provides open/close driving of the exhaust valves 12L, 12R at predetermined timing by way of the exhaust rocker arms 26L, 26R.

The cam holder 30 which pivotally supports the camshaft 21 of the valve system 20 is mounted on the cylinder head 2 which constitutes the fuel combustion chamber 6 therein above the fuel combustion chamber 6.

In other words, the cam holder 30 is fastened to the upper bottom wall 2*b* of the valve chamber 5. As shown in FIG. 2, the left support wall 32L and the right support wall 32R of the cam holder 30 are mounted at left and right symmetrical positions with respect to the cylinder center axis C.

The upper bottom wall 2*b* which constitutes the fuel combustion chamber 6 repeats expansion and contraction thereof due to a change of pressure in the fuel combustion chamber 6 and hence, to the left support wall 32L and the right support wall 32R which are arranged at the left and right symmetrical positions with respect to the cylinder center axis C of the cam holder 30 mounted on the bottom wall 2*b* which expands and contracts, a force which tends to widen or narrow the distance between these support walls as indicated by broken-line arrows Lx, Rx shown in FIG. 2 is applied.

In the cam holder 30 of this embodiment, the left support wall 32L and the right support wall 32R which has bottom sides thereof joined with each other by the bottom wall 31 have rear side portions thereof joined with each other by the rear side wall 35 and, at the same time, have upper portions of front side portions thereof (front portions of upper side portions thereof) joined with each other by the rib 39.

Accordingly, the cam holder 30 can possess the extremely high structural rigidity without increasing a wall thickness and hence, even when the force which tends to widen or narrow the distance between the left support wall 32L and the right support wall 32R is applied to these support walls, the deformation of the cam holder attributed to the widening or narrowing of the distance between these support walls can be prevented against such a force whereby the durability of the cam holder can be enhanced while realizing the reduction of the weight of the cam holder.

Further, the rocker bearing boss portions 34LL, 34LR, 34RL, 34RR are formed on a front side portion of the bottom wall 31 to which the lower sides of the left support wall 32L and the right support wall 32R of the cam holder 30 are joined. The left exhaust rocker arm 26L and the right exhaust rocker arm 26R are rockably and pivotally supported on the cam holder 30 respectively by way of the rocker arm shafts 25L, 25R.

To explain the constitution of this embodiment in conjunction with FIG. 1, rear end portions of the left and right exhaust rocker arms 26L, 26R receive a force U in the direction indicated by a broken-line arrow due to the exhaust cam robes 23L, 23R by way of the rollers 27L, 27R, while the front end portions 26La, 26Ra simultaneously receive a force V in the direction indicated by a broken-line arrow due to the valve springs 15, 15 of the exhaust valves 12L, 12R. Therefore, a resultant force W of the above-mentioned forces U and V acts on the left and right rocker arm shafts 25L, 25R which pivotally support the exhaust rocker arms 26L, 26R in the direction indicated by a broken-line arrow.

Figure 7:
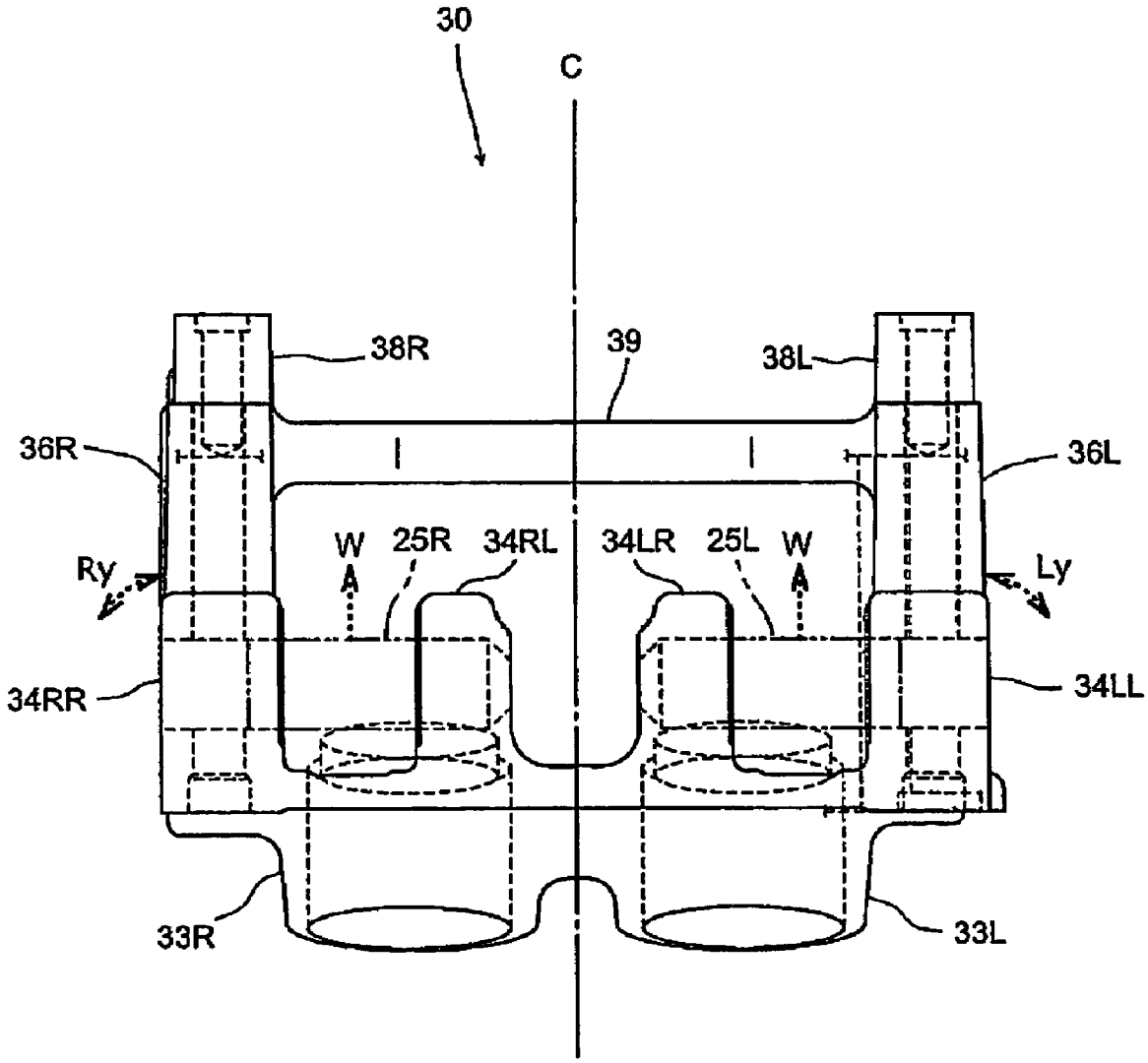
FIG. 7 is a front view of the cam holder (viewed in a direction indicated by an arrow VII in FIG. 6).
Figure 8:
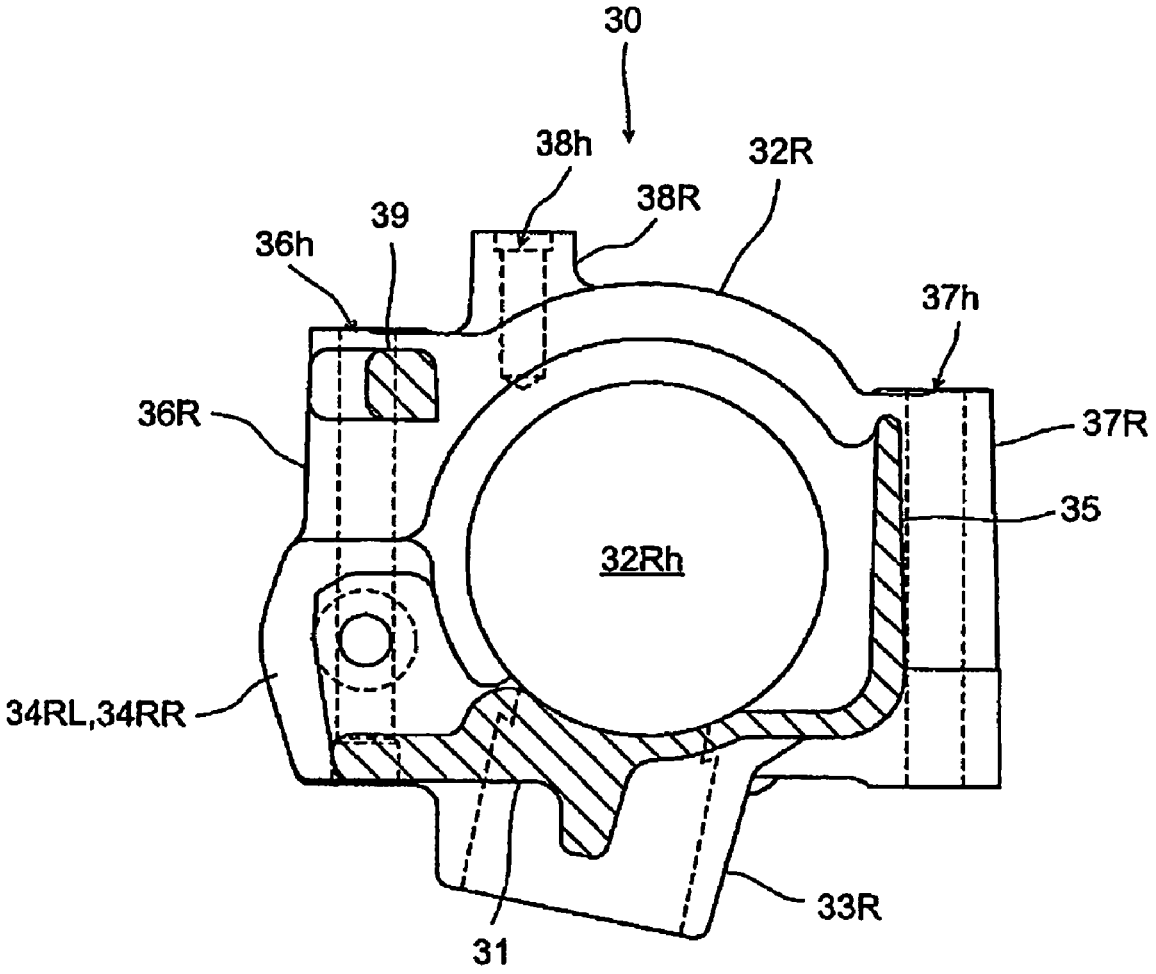
FIG. 8 is a cross-sectional view taken along a line VII-VII in FIG. 6.

The resultant force W which respectively acts on the left and right rocker arm shafts 25L, 25R is, as shown in FIG. 7, directed upwardly (in the oblique and frontward direction) and hence, an upward force is applied to the inner rocker bearing boss portions 34LR, 34RL which support the rocker arm shafts 25L, 25R, and a force is applied to the outer rocker bearing boss portions 34LL, 34RR in the direction which tends to widen or narrow the distance between the left and right support walls as indicated by the broken-line arrows Ly, Ry.

In other words, although the force which tends to widen or narrow the distance between the left and right support walls is applied to the front side portions (mounting boss portions 36L, 36R) of the support walls 32L, 32R integrally formed with the rocker bearing boss portions 34LL, 34RR, the upper portions of the front side portions (front portion of the upper side portions) of the left and right support walls 32L, 32R are joined with each other by the rib 39 in the cam holder 30 of this embodiment.

Hence, even when the force which tends to widen or narrow the distance between the left and right support walls is applied to the front side portions of the support walls 36L, 36R, the deformation of the cam holder 30 attributed to the widening or narrowing of the distance between the left and right support walls can be prevented against such a force whereby it is possible to enhance the durability of the cam holder 30 and realize the reduction of weight of the cam holder 30.

The rib 39 is integrally formed on the cam holder 30 of this embodiment. Hence, the number of parts can be reduced thus simplifying assembling of the cam holder 30.

Here, in the cam holder 30 of this embodiment, a rear side of the bottom wall 31 contiguously extends upwardly to form the rear side wall 35 and hence, a corner portion which is contiguously formed with the bottom wall 31 and the rear side wall 35 provides an oil reservoir where the intake cam robes 22L, 22R and the exhaust cam robes 23L, 23R of the camshaft 21 can be sufficiently lubricated.

Figure 9:
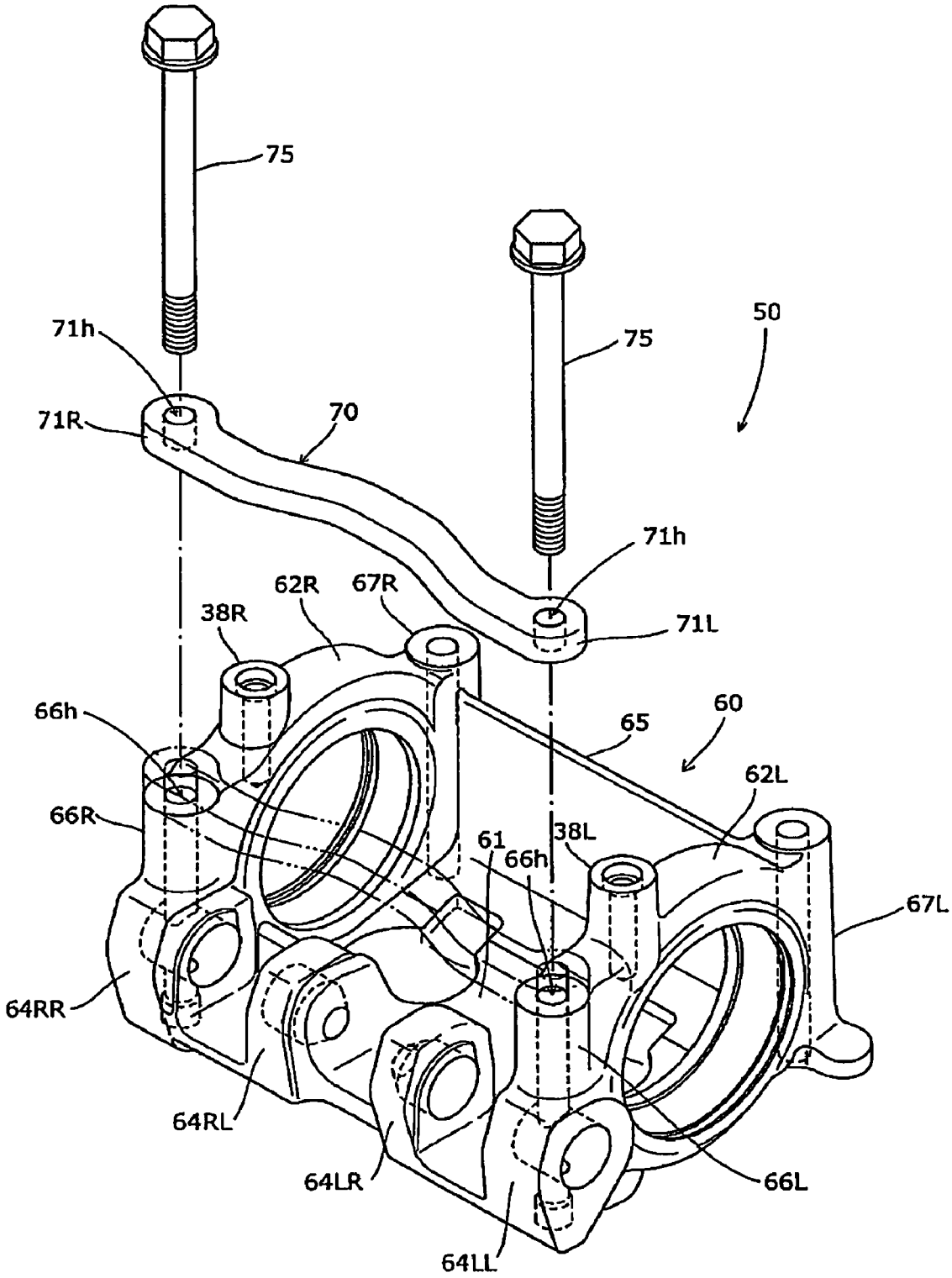
FIG. 9 is an exploded perspective view of a cam holder according to another embodiment of the present invention.

Next, an embodiment in which the rib is formed separately from the cam holder body is explained in conjunction with FIG. 9.

A cam holder 50 of this embodiment has substantially same shape as the above-mentioned cam holder 30 except for that a cam holder body 60 excludes the rib 39. Lower sides of left and right support walls 62L, 62R are joined with each other by a bottom wall 61, rocker bearing boss portions 64LL, 64LR, 64RL, 64RR are formed on a front side of the bottom wall 61, and a rear side wall 65 which extends upwardly contiguously from a rear side of the bottom wall 61 is formed so as to joined both rear side portions of the left and right support walls 62L, 62R.

Mounting boss portions 66L, 66R are formed on respective front side portions of the left and right support walls 62L, 62R, mounting boss portions 67L, 67R are formed on the respective rear side portions of the left and right support walls 62L, 62R, and mounting boss portions 68L, 68R are formed on portions of the respective upper side portions at positions closer to the center of the respective side portions from a front side.

A rib 70 formed of a plate-shaped member is separate from the above-mentioned cam holder body 60. Mounting boss portions 71L, 71R formed on both ends of the rib 70 are made to overlap upper end surfaces of the mounting boss portions 66L, 66R of the respective front side portions of the left and right support walls 62L, 62R of the cam holder body 60 from above. Flange bolts 75, 75 are made to penetrate bolt holes 71*h*, 71*h* formed in the mounting boss portions 71L, 71R and bolt holes 66*h*, 66*h* formed in the mounting boss portions 66L, 66R, and are threaded into screw holes formed in a mounting boss portions of the cylinder head thus fastening the rib 70 to the cam holder body 60.

By joining the rib 70 to the front ends of the upper side portions of the left and right support walls 62L, 62R by fastening both left and right ends of the rib 70 to the front ends of the upper side portions of the left and right support walls 62L, 62R, the cam holder 50 of this embodiment exhibits the high structural rigidity and hence, the deformation of the cam holder 50 attributed to the widening or narrowing of the distance between the left and right support walls 62L, 62R can be prevented without increasing a wall thickness thus realizing the enhancement of durability and the reduction of weight of the cam holder.

Since the rib 70 is separately formed from the cam holder body 60, a cross-sectional area and a shape of the rib can be easily changed.

The rib 70 can be fastened to the cam holder body 60 using the flange bolts 75, 75 which are also used for fastening the cam holder body 60 to the cylinder head and hence, the rigidity and the strength of the cam holder can be adjusted with the simple constitution.

In the valve system of the overhead-camshaft-type internal combustion engine according to the above-mentioned embodiments, the intake cam robes formed on the camshaft directly drive the intake valves.

However, in a valve system which is configured to also drive the intake valves by way of the intake rocker arms, the rocker bearing boss portions can be formed not only on the front side portion of the bottom wall of the cam holder but also on the rear side portion of the bottom wall of the cam holder and the intake rocker arm is rockably and pivotally supported on these rocker bearing boss portions.

In such a cam holder, by joining both front ends of the upper side portions of the left and right support walls and by simultaneously joining the rear ends of the upper side portions using the rib, it is possible to ensure the rigidity of the cam holder without increasing a wall thickness, thus realizing the enhancement of the durability of the cam holder and the reduction of weight of the cam holder.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A valve system of an overhead-camshaft-type internal combustion engine including a cylinder head having a combustion chamber formed therein, said valve system comprising a camshaft;

a cam holder supporting said camshaft, said cam holder being fastened to the cylinder head, and being disposed above said combustion chamber;

said cam holder comprising a bottom wall, and a pair of oppositely-facing support walls having lower sides thereof joined to each other by said bottom wall; said pair of oppositely-facing support walls pivotally supporting said cam shaft;

a plurality of rocker arms; and a rib joining predetermined oppositely-facing portions of respective upper side portions of said support walls with each other; said rib extending between the upper side portions of said support walls such that a gap is formed between said bottom wall and said rib;

wherein said cam holder further comprises a plurality of rocker bearing portions, each of which rockably and pivotally support respective one of said rocker arms in a vicinity of respective side portions of said support walls; and wherein portions of the respective upper side portions of said support walls located above the rocker bearing portions are joined to each other by the rib.

2. A valve system of an overhead-camshaft-type internal combustion engine according to claim 1, wherein said rib is integrally formed with the cam holder.

3. A valve system of an overhead-camshaft-type internal combustion engine according to claim 1, further comprising a fastening member for fastening said cam holder to said cylinder head;

wherein said rib is separate from the cam holder, and extends between said predetermined oppositely-facing portions of respective upper side portions of said support walls; and wherein said rib is fastened together with said cam holder using said fastening member to the cylinder head.

4. A valve system of an overhead-camshaft-type internal combustion engine according to claim 1, wherein said cam holder further comprises a side wall extending upwardly from said bottom wall of the cam holder; wherein said side wall is configured to join oppositely-facing side portions of said support walls on a side opposite to side portions of said support walls on which the rocker bearing portions are formed.

5. An overhead-camshaft-type internal combustion engine, comprising:

a cylinder head having a combustion chamber formed therein;

a plurality of rocker arms;

a camshaft;

a cam holder supporting said camshaft, said cam holder being fastened to said cylinder head, and being disposed above said combustion chamber;

said cam holder comprising a bottom wall; and a pair of oppositely-facing support walls having lower sides thereof joined to each other by said bottom wall; said pair of oppositely-facing support walls pivotally supporting said cam shaft; and a rib joining predetermined oppositely-facing portions of respective upper side portions of said support walls with each other; said rib extending between the upper side portions of said support walls such that a gap is formed between said bottom wall and said rib;

wherein said cam holder further comprises a plurality of rocker bearing portions, each of which rockably and pivotally support respective one of said rocker arms in a vicinity of respective side portions of said support walls; and wherein portions of the respective upper side portions of said support walls located above the rocker bearing portions are joined to each other by said rib.

6. An overhead-camshaft-type internal combustion engine according to claim 5, wherein said rib is integrally formed with the cam holder.

7. An overhead-camshaft-type internal combustion engine according to claim 5, further comprising a fastening member for fastening said cam holder to said cylinder head; wherein said rib is separately formed from the cam holder, and has a plate-shaped profile; and wherein said rib is fastened together with said cam holder to the cylinder head using said fastening member.

8. An overhead-camshaft-type internal combustion engine according to claim 5, wherein said cam holder further comprises a side wall, wherein said side wall extends upwardly from said bottom wall of the cam holder, and joins oppositely-facing side portions of said support walls on a side opposite to side portions of said support walls on which the rocker bearing portions are formed.

9. An internal combustion engine, comprising:

a cylinder head having a combustion chamber formed therein;

a plurality of rocker arms;

a camshaft;

a cam holder being fastened to said cylinder head, and being disposed above said combustion chamber;

said cam holder comprising a bottom wall;

a pair of oppositely-facing support walls having lower sides thereof joined to each other by said bottom wall; said pair of oppositely-facing support walls pivotally supporting said camshaft; and a side wall extending upwardly from said bottom wall; and a plate-shaped rib joining predetermined oppositely-facing portions of respective upper side portions of said support walls with each other; said rib extending between the upper side portions of said support walls such that a gap is formed between said bottom wall and said rib;

wherein said cam holder further comprises a plurality of rocker bearing portions, each of which rockably and pivotally support respective one of said rocker arms; and wherein portions of the respective upper side portions of said support walls located above the rocker bearing portions are joined by said rib.

10. An internal combustion engine according to claim 9, wherein said rib is integrally formed with said cam holder.

11. An internal combustion engine according to claim 9, further comprising a fastening member for fastening said cam holder to said cylinder head;

wherein said rib is separate from the cam holder, and extends between said predetermined oppositely-facing portions of respective upper side portions of said support walls; and wherein said rib is fastened together with said cam holder using said fastening member to the cylinder head.

12. An internal combustion engine according to claim 9, wherein a central portion of said plate-shaped rib is slightly bent in a rearward direction.

13. An internal combustion engine according to claim 9, wherein said rib is situated opposite to said side wall.

* * * * *